US005196106A

United States Patent [19]

DuPree et al.

[11] Patent Number: 5,196,106

[45] Date of Patent: Mar. 23, 1993

[54] INFRARED ABSORBENT SHIELD

[75] Inventors: Don DuPree, Alta Loma; Neil E. Mattson, Ontario; Jack E. Cunningham, Huntington Beach, all of Calif.

[73] Assignee: Optical Radiation Corporation, Azusa, Calif.

[21] Appl. No.: 673,231

[22] Filed: Mar. 20, 1991

[51] Int. Cl.[5] ..... C25D 1/00

[52] U.S. Cl. ..... 205/67

[58] Field of Search ..... 204/3, 42

[56] References Cited

U.S. PATENT DOCUMENTS

| | | | |
|---|---|---|---|
| 3,971,674 | 7/1976 | Brandt et al. | 148/6.27 |
| 4,085,012 | 4/1978 | Marceau et al. | 204/38 |
| 4,111,762 | 9/1978 | Wade et al. | 204/33 |
| 4,127,451 | 11/1978 | Marceau et al. | 204/38 |
| 4,209,569 | 6/1980 | Brugger | 428/472 |
| 4,228,220 | 10/1980 | Garrison | 428/434 |
| 4,253,022 | 2/1981 | Allen et al. | 250/349 |
| 4,286,009 | 8/1981 | Griest | 428/212 |
| 4,312,915 | 1/1982 | Fan | 428/323 |
| 4,440,606 | 4/1984 | Powers et al. | 204/33 |
| 4,442,166 | 4/1984 | Fan | 428/323 |
| 4,589,972 | 5/1986 | Pompea et al. | 204/29 |
| 4,793,903 | 12/1988 | Holmquist et al. | 204/33 |
| 4,853,098 | 8/1989 | Drinkwine | 204/192.28 |

*Primary Examiner*—T. M. Tufariello

*Attorney, Agent, or Firm*—Christie, Parker & Hale

[57] ABSTRACT

A process for forming an infrared absorbing cold shield which comprises anodizing an aluminum mandrel for the cold shield to provide a porous layer of aluminum oxide over the surface of the mandrel. The anodized mandrel is then immersed in an electroforming solution and metal is electrolytically deposited into and over the aluminum oxide layer. The aluminum mandrel is then selectively dissolved, leaving a metal body of the electroformed metal with a layer of infrared absorbing aluminum oxide mechanically anchored to the interior surface of the metal body.

12 Claims, 1 Drawing Sheet

INFRARED ABSORBENT SHIELD

FIELD OF THE INVENTION

This invention relates to the field of infrared absorbent shields and more particularly to a process for producing an electrodeposited metal shield having an infrared absorbent material mechanically anchored to a surface thereof.

SUMMARY OF THE INVENTION

Infrared (IR) detectors used in IR cameras, IR guidance systems for missiles, and the like require a thin metal shield to surround the detector. The shield, sometimes referred to as a cold shield or radiation shield, protects the detector from stray IR radiation. The shield typically has an aperture in the top to allow a prescribed cone of light to strike the detector contained therein.

Cold shields are often made by electrodepositing nickel, copper, nickel-cobalt, or combinations of such metals onto an aluminum mandrel. Often, the aluminum mandrel is coated with a zinc deposit and/or copper strike prior to the actual forming so that the electrodeposited metal will adhere to the mandrel surface and thereby prevent loss of adhesion during electrodeposition or post-plate machining. After the electroforming operation is completed and post-plate machining accomplished, the aluminum mandrel is dissolved, e.g., in an alkaline solution, such as sodium hydroxide. The zinc and/or copper strike coating is then stripped off the interior of the shield once the mandrel has been dissolved.

The shields are ordinarily coated on the outside surface with gold or other materials that are reflective to IR radiation. The shields are coated on their interior surfaces with materials that are absorbent to IR radiation. The absorbent coatings are usually paints containing various fillers, such as carbon black.

The adherence, thickness, uniformity, stability, and out-gassing properties of paints used to coat the interior of cold shields are of great concern. Application of paint to the interior of a typical 0.003-inch wall structure, due to the fragile nature and tight tolerances required, is difficult. The shields typically operate at cryogenic temperatures in a hard vacuum, i.e., up to about $10\times10^{-14}$ Torr.

Such an environment may affect the adherence, stability and outgassing properties of the paint. For example, flaking of the absorbent paint may occur, which is a concern since a flake could cover the infrared detector. Further, paints tend to out-gas in the hard vacuum environment in which the shields operate. Outgassing can contaminate the detector and thereby adversely affect its operation. The wall thickness and weight of these shields is critical, as is the thermal mass and conductivity of the materials forming the shields since the shields and detector must be cooled to cryogenic temperature quickly. This is especially true in devices such as shoulder-fire missile launchers. In such a device, once a target is spotted and the cryogenic pump activated, the missile cannot be fired until the detector and shield reach cryogenic temperature. This is because the detector is otherwise blinded by stray radiation when warm.

There is a need for an IR shield having an IR absorbent coating on its interior surface which is thin, very adherent, uniform in thickness, and not subject to outgassing.

SUMMARY OF THE INVENTION

The present invention provides an IR absorbent shield comprising an electrodeposited metal body and a layer of non-metallic IR absorbent material mechanically anchored to the surface of the electrodeposited metal body. The electrodeposited metal body preferably comprises a metal selected from the group consisting of copper, nickel, nickel-cobalt, or combinations thereof. The IR absorbent material is preferably selected from the group consisting of aluminum oxide, silicon carbide, carbon black, and mixtures or combinations thereof. Any electrodeposited metal exposed at the surface of the IR absorbent layer is preferably oxidized.

There is also provided a process for providing a shaped IR absorbent shield comprising a metal body having a layer of IR absorbent material mechanically anchored to the interior surface of the metal body. The process comprises, first providing a shaped aluminum mandrel. The aluminum mandrel is anodized to provide a layer of porous aluminum oxide over the surface of the mandrel. The anodized aluminum mandrel is then immersed in an electroforming solution and is electroformed. Metal from the electroforming solution deposits in the pores of the aluminum oxide layer and then continues to deposit over the entire surface of the aluminum oxide layer. Electroforming continues until the metal deposit builds up to the desired thickness to thereby form the metal body of the shield. The aluminum mandrel with electrodeposited metal body is then immersed in a solution for dissolving aluminum metal without dissolving the electrodeposited metal or aluminum oxide. Immersion is continued until the aluminum mandrel is dissolved, leaving an IR absorbent shield comprising a metal body with an aluminum oxide layer mechanically anchored to the interior surface of the metal body.

Preferably, any exposed electrodeposited metal which has penetrated the pores in the aluminum oxide layer is oxidized, e.g., by immersion in an oxidizing solution or heating in an oxidizing atmosphere It is also preferred to electroplate the metal body with gold before dissolving the aluminum mandrel.

In a preferred process, the mandrel is sandblasted to roughen its surface before anodizing. This results in a cold shield having a rough inner surface layer of aluminum oxide. Such a rough surface absorbs IR radiation better than a smooth surface. While it is preferred that the inner surface of the cold shield be rough, it is also preferred that the outer surface be smooth. Accordingly, in such a process, it is preferred to form a smooth exterior surface by electropolishing or by electrodepositing at least the final layer of the metal body from a leveling metal electrodeposition solution.

In yet another preferred process, the aluminum mandrel is first coated with a nonconductive material which is tacky when wet. Before drying, the tacky coating is coated with an IR absorbent material, preferably silicone carbide or carbon black, in a fine powder form. An electrolessly deposited layer of metal is then applied to the surface of the coated aluminum mandrel by conventional electroless plating techniques. The electrolessly-coated mandrel is then electroplated to build up a layer of metal over the surface of the aluminum mandrel. The aluminum mandrel is then removed by dissolution with an alkaline sodium hydroxide solution or the like.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
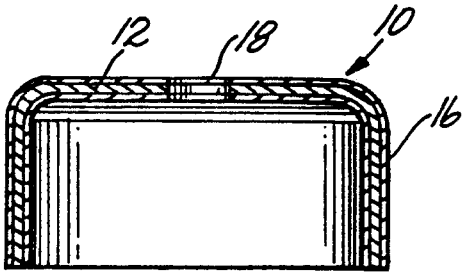
FIG. 1 is a cross-sectional view of a cold shield constructed in accordance with the present invention.

A particularly preferred application of the present invention is in the manufacture of cold shields for IR detectors. As shown in FIG. 1, the cold shield 10 comprises a generally cylindrical metal body 12 having a closed upper end and an open lower end. An IR absorbent layer of aluminum oxide 14 is mechanically anchored to the interior surface of the metal body 12. An infrared reflecting layer of gold 16 covers the exterior surface of the metal body 12. An aperture 18 is provided in the upper end of the metal body 12.

In the embodiment shown, the metal body 12 is made of nickel. Other preferred metals include copper and nickel-cobalt alloys. However, it is understood that a variety of metals may be used to form the metal body. Suitable metals are those that can be electrolytically deposited over an aluminum substrate in an electroforming process.

The thickness of the metal body 12 depends on the particular application and the particular metal or metals used to form the metal body. For cold shield applications, it is desired to minimize the metal body thickness in order to obtain cryogenic temperatures at the fastest rate. The thickness, however, must be sufficient to provide adequate structural stability for the application in which the metal body is used. A metal body thickness of from about 0.001 to about 0.004 inch and preferably about 0.002 to about 0.003 inch is presently preferred as such thicknesses generally provides adequate structural stability for cold shield applications. It is understood that the metal body may be thicker if desired.

The aluminum oxide layer comprises aluminum oxide and oxides or sulfides of the metal forming the metal body. The thickness of the infrared absorbent aluminum oxide layer is not critical. Thicknesses of from about 0.0001 to about 0.0005 inch are preferred. Thicknesses less than about 0.0001 inch are not preferred, because there is a tendency for such layers not to absorb sufficient IR radiation for some applications. Thicknesses greater than about 0.0005 inch are not preferred, because it becomes difficult to electroform the metal body over such thick aluminum oxide layers in the preferred electroforming process described below.

The surface finish of the aluminum oxide layer is preferably rough. A particularly preferred finish comprises irregular cone shaped depressions having diameters of from about 2.5 microns to about 30 microns. Such a surface is described in U.S. Pat. Nos. 4,589,972 and 4,111,762 which are incorporated herein by reference. It has been found that such rough finishes tend to absorb IR radiation better than smoother finishes. Surface finishes greater than about 125 RMS are not preferred because on such surfaces tend to make it difficult to obtain a smooth exterior surface by the preferred electroforming process described below.

The thickness of the gold layer over the exterior of the metal body is preferably about 0.00005 inch. It is understood, however, that the thickness of the gold layer may vary as desired.

Figure 2:
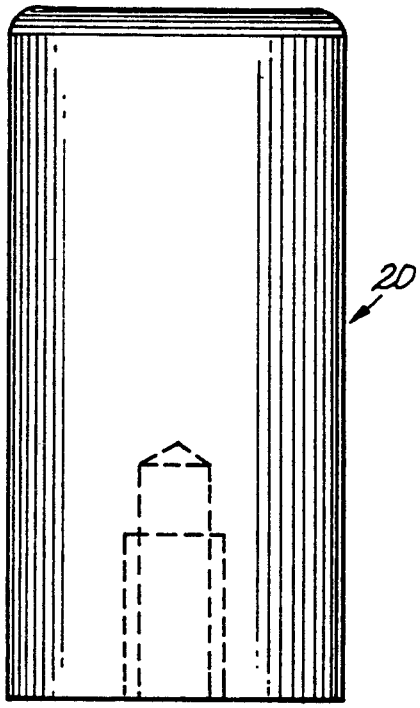
FIG. 2 is a cross-sectional view of an aluminum mandrel used in formation of the cold shield of FIG. 1.

A preferred process for forming such an absorbing cold shield comprises first providing an aluminum mandrel having an exterior configuration corresponding to the interior configuration of the cold shield. FIG. 2 shows an aluminum mandrel 20 useful in the preparation of the cold shield 10 shown in FIG. 1. The surface of the mandrel 20 is preferably roughened by wet or dry sand blasting techniques, as is well known in the art. Abrasive media having a grit of from about 0.002 inch to about 0.010 inch is preferred. Silicon carbide having a grit size of about 180 is presently preferred. Sand blasting is preferably performed for a time sufficient to roughen the mandrel surface to a finish of from about 32 to about 64 RMS.

The mandrel is then anodized according to known techniques. Presently, it is preferred that the anodizing solution be a phosphoric acid anodizing solution. Suitable phosphoric acid anodizing solutions are disclosed, for example, in U.S. Pat. Nos. 4,793,903; 4,127,451; and 4,085,012, all assigned to The Boeing Company, which are incorporated herein by reference. It has been found that phosphoric acid anodizing solutions tend to create an aluminum oxide coating having larger pores than, for example, sulfuric acid anodizing solutions. Such larger pores enable better mechanical bonding with the subsequent electrodeposited metal than the smaller pores which result from a sulfuric acid anodizing solution.

Anodizing is carried out sufficiently long to provide an oxide layer of at least about 0.0001 inch and preferably at least about 0.0002 inch.

The anodized process may be varied widely. A presently preferred anodizing solution comprises 16 ounces of 75% concentration phosphoric acid per gallon of water. The solution is maintained at a temperature of from 65° to about 85° F., and the aluminum mandrel is immersed as the anode using a stainless steel cathode for 10 to 30 minutes at a voltage of 10±1 volts DC.

Figure 3:
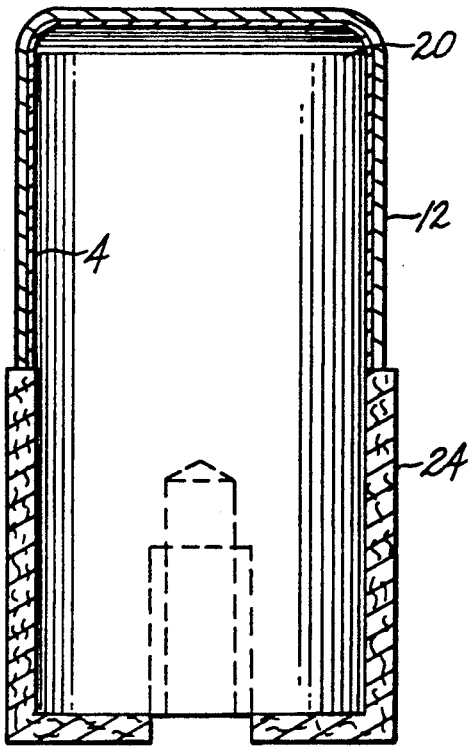
FIG. 3 is a cross-sectional view of the mandrel of FIG. 2 after electroforming.

As shown in FIG. 3, after anodizing, a nonconductive mask 24 is applied over the lower portion of the mandrel. This is done to prevent electrolytic deposits over this part of the mandrel. Any suitable masking material may be used. Electroplater's tape is presently preferred. Preferably, the exposed upper portion of the mandrel is slightly longer than that corresponding to the size of the finished cold shield. This enables the electroforming of a metal body slightly larger than that of the finished cold shield, which can then be machined with precision to the final size.

The mandrel is then immersed in an electroforming solution and the metal body 12 is electroformed over the anodized aluminum mandrel 20. The electroforming solution is preferably a copper, nickel, or nickel-cobalt electroforming solution. Nickel is presently preferred. A presently-preferred nickel electroforming solution comprises about 60 oz./gal. nickel sulfamate, 5 oz./gal. boric acid, and 0.05 oz./gal. of a surfactant and optionally 2 oz./gal. nickel chloride. The operating pH is about 4.2, and the anodized mandrel is immersed for a period of about 1 to 3 hours at a current density of 20 to 60 amps/ft$^2$ 1 to 2 volts DC. Such a nickel plating solution provides a highly ductile deposit.

Because the anodized layer is porous, some aluminum metal is exposed to the electroforming solution, and electrolytic deposition occurs. The depositing metal initially fills the pores and then covers the entire anodized aluminum oxide layer, forming the metal body. Deposition of metal into the pores of the oxide layer provides a mechanical bond between the aluminum oxide layer and the electrodeposited metal.

Metal deposition is continued until the required thickness of the deposited metal is achieved. Following electrodeposition, the exterior surface of the metal body typically has a dull matte finish reflecting the underlying sandblasted mandrel surface.

It is generally desirable that the exterior surface of the cold shield be gold plated and have a smooth, specular surface. This provides an exterior surface highly reflective of IR radiation. Accordingly, in a particularly preferred embodiment of the invention, the deposition of the metal from the electroforming solution is continued to achieve a deposit thickness approximately 0.0005 inch greater than the required final dimension. The mandrel and electrodeposited metal layer are then rinsed and immersed in an electropolishing solution. The mandrel and deposited metal layer are made anodic to a suitable cathode, e.g., stainless steel. In the electropolishing process, metal is preferentially removed from the peaks of the surface of the electrodeposited layer. Electropolishing is continued until a smooth, specular surface and the correct dimensions are achieved.

Any suitable electropolishing solution may be used. A presently preferred electropolishing solution comprises about 70% by volume sulfuric acid and 30% by volume water. The electropolishing solution is maintained at room temperature. Removal of about 0.0005 inch of electrodeposited metal typically requires an immersion of from about 1 to 2 minutes at 6 VDC.

Figure 4:
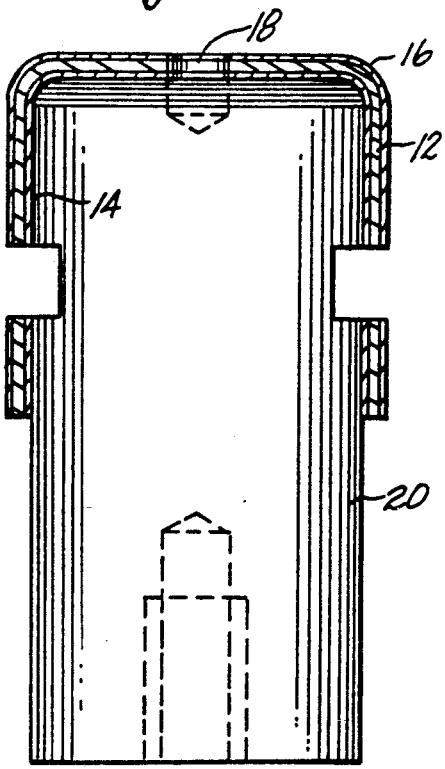
FIG. 4 is a cross-sectional view of the mandrel and electroformed metal body after final machining.

With reference to FIG. 4, after electropolishing, the aperture 18 is machined into the metal body 12 and aluminum mandrel 20, and the metal body 12 is machined to proper length. Further, any slots, ridges, or the like required in the final cold shield product are machined into the metal body, and the metal body is machined to the required final dimensions.

The mandrel 20 and metal body 12 are then immersed in a gold plating solution, and a layer of gold is plated over the metal body. The gold layer 16 is deposited to any desired thickness and typically to a thickness of about 0.00005 inch. Any commercially available gold plating solution may be used. A presently preferred gold plating solution is marketed by Technic under the trade name Orosene 999.

After gold plating, the mandrel 20 is dissolved. Dissolution of the aluminum mandrel can be accomplished in a variety of acid or alkaline solutions. A presently preferred solution is sodium hydroxide at 8 to 16 ounces per gallon. The solution may be maintained at room temperature up to about 250° F. Other suitable solutions for dissolving the aluminum mandrel include potassium hydroxide or hydrochloric acid if diluted to about 50% strength and maintained at a temperature below about 100° F.

Once the mandrel is dissolved, the anodized layer is firmly attached to the interior of the deposited metal body. The metal which is electrolytically deposited into the pores and which is exposed to the surface of the aluminum oxide layer is preferably oxidized. This may be accomplished by immersion in oxidizing solutions, such as hydrogen peroxide, or by heating to 400° to 600° F. in air. If the electrodeposited metal is copper, a copper sulfide coating may be formed, for example, by exposing to a polysulfide solution or to a commercially available conversion coating.

The aluminum oxide is a good IR absorber in itself and, when combined with oxides of the metal deposited into the porous oxide layer, the result is a superior IR absorber. The IR absorbing layer also meets other criteria. For example, it is very thin, typically less than 0.0005 inch, and preferably about 0.0002 inch. This compares favorably to paint which is typically on the order of 0.002 inch. The infrared absorbent layer comprising aluminum oxide and metal oxides will not flake and will not out-gas in a vacuum.

It is apparent that many variations in the above-described embodiment can be made without departing from the scope of this invention. For example, it is apparent that, while preferred, the aluminum mandrel need not be sandblasted prior to anodizing. If electrodeposition occurs over a smooth mandrel, the surface of the electrodeposited metal will be smooth, and there will be no need to electropolish the deposited metal.

If the aluminum mandrel is sandblasted, it is understood that any suitable method may be used to form a metal body having a smooth exterior surface. For example, rather than electropolishing, the metal body may be formed in whole or in part with a leveling metal plating solution. Such leveling metal plating solutions are readily commercially available and are used extensively in the electroplating industry to form bright, shiny electroplated surfaces on metal and electrolessly plated plastic substrates.

In one such embodiment of the invention, the metal body is electroformed with a nickel electroforming solution as described above. However, electroforming is stopped when the thickness of the deposited nickel is about 0.0005 inch less than the required thickness. Thereafter, the mandrel is immersed in a leveling nickel plating solution and nickel is electrodeposited to obtain the required thickness and to form a smooth, specular finish. A layer of gold is then electroplated over this smooth, specular surface.

While it is preferred to have a layer of gold covering the exterior surface of the shield to increase IR radiation reflectance, it is understood that such a layer is not required. If an additional layer of an IR reflecting metal is desired, such a layer may comprise metals other than gold, such as rhodium or silver. Further, if desired, such an IR reflecting layer may be applied to the metal body before machining or after the aluminum mandrel has been dissolved, although special care must be taken to assure that no gold (or other metal) is deposited over the interior surface of the shield.

As indicated above, apertures, grooves, etc. are preferably machined into the metal body before the aluminum mandrel is dissolved, and before gold plating. As an alternative, the aluminum mandrel may be shaped with apertures, grooves, etc. so that the metal body is electroformed with corresponding apertures, grooves, etc. In such an embodiment, the need for machining is reduced, if not eliminated.

It is also understood that other nonconductive IR materials may be mechanically anchored to the interior surface of the metal body. For example, in another preferred embodiment of the invention, a thin coating of a tacky substance, e.g., lacquer, wax, adhesive, or the like, is applied to the aluminum mandrel surface. Preferred substances are those which, when dry, are platable by conventional electroless plating techniques. Before the coating dries and while it is still tacky, a fine powder of an IR absorbent material is applied to the coating. Preferred IR absorbing materials include silicone carbide and carbon black having a mesh size of 1200 or more. The coating is then allowed to dry. The coated mandrel is then electrolessly plated to chemically deposit a layer of metal over the nonconductive coating on the surface of the mandrel. Electroless deposition is accomplished by conventional means. Such conventional electroless deposition processes typically involve immersion in a chemical etchant, followed by immersion in a catalyst solution containing, for example, colloidal palladium, immersion in an electroless plating solution.

Once the mandrel is completely covered by the electroless deposit, the mandrel is then immersed in an electroforming solution in which the metal body is electrolytically deposited as previously described. The aluminum mandrel is then dissolved as described above, yielding an electroformed metal body having a layer of IR absorbent material on its interior surface. Metal chemically deposits on the surface of the coated mandrel, surrounding and at least partially enveloping the particles of IR absorbent material adhered to the surface of the mandrel.

For the above reasons, the foregoing description should not be read as pertaining only to the precise structures described and shown in the accompanying drawings, but rather should be read consistent with and as support to the following claims which are to have their fullest fair scope.

What is claimed is:

1. A method for preparing an infrared absorbent shield comprising:

providing a dissolvable metal substrate;

forming a layer of infrared absorbing material over the substrate;

forming a layer of metal over the surface of the infrared absorbing material; and selectively dissolving the metal of the substrate to thereby form an infrared absorbent shield comprising a layer of metal and a layer of infrared absorbent material mechanically anchored to a surface of the metal layer.

2. A method as claimed in claim 1 wherein the dissolvable metal is aluminum.

3. The method as claimed in claim 1 wherein the infrared absorbing material is selected from the group consisting of aluminum oxide, silicon carbide and carbon black.

4. The method as claimed in claim 1 wherein the metal of the metal layer is selected from the group consisting of copper, nickel, and nickel-cobalt alloys.

5. A method for preparing an infrared absorbent shield comprising:

providing an aluminum mandrel;

immersing the aluminum mandrel in an anodizing solution and anodizing the aluminum mandrel to thereby generate a porous layer of aluminum oxide over the surface of the aluminum mandrel;

immersing the anodized aluminum mandrel in an electrolytic metal plating solution and electyrolytically depositing metal in the pores and over the surface of the aluminum oxide layer; and selectively dissolving the aluminum metal of the aluminum mandrel to thereby form an infrared absorbent shield comprising a metal body of the electrolytically deposited metal and a layer of infrared absorbent aluminum oxide mechanically anchored to the surface of the metal body.

6. The method as claimed in claim 5 further comprising oxidizing any electrolytically deposited metal exposed at the surface of the aluminum oxide layer.

7. The method as claimed in claim 5 wherein the electrolytically deposited metal is selected from the group consisting of copper, nickel, and nickel-cobalt alloys.

8. The method as claimed in claim 5 further comprising, before selectively dissolving the aluminum metal, electrolytically depositing a layer of gold over the electrolytically deposited metal body.

9. The method as claimed in claim 5 wherein the aluminum mandrel is anodized for a time sufficient to generate an aluminum oxide layer at least about 0.0001 inch thick.

10. The method as claimed in claim 5 further comprising, prior to immersing the aluminum mandrel in an anodizing solution, sandblasting the aluminum mandrel to provide a surface finish of from about 32 to about 64 RMS.

11. The method as claimed in claim 10 further comprising, prior to selectively dissolving the aluminum metal of the aluminum mandrel, electropolishing the electrolytically deposited metal to thereby form a smooth surface.

12. The method as claimed in claim 10 further comprising, prior to selectively dissolving the aluminum metal of the aluminum mandrel, immersing the metal plated aluminum mandrel in a leveling metal plating solution and electrolytically depositing metal rom the leveling metal plating solution onto the metal plated substrate to thereby form a smooth surface.

* * * * *